United States Patent [19]

Chandler

[11] Patent Number: 5,062,539

[45] Date of Patent: Nov. 5, 1991

[54] COMPARTMENTALIZED REFUSE CONTAINER

[76] Inventor: John W. Chandler, 131 NW. 55th St., Seattle, Wash. 98107

[21] Appl. No.: 558,145

[22] Filed: Jul. 25, 1990

Related U.S. Application Data

[63] Continuation-in-part of Ser. No. 349,325, May 8, 1989.

[51] Int. Cl.[5] ..... B65D 21/02

[52] U.S. Cl. ..... 220/4.27; 220/4.26; 220/212; 220/630; 220/909; 206/508; 232/43.1; 232/43.5

[58] Field of Search ..... 220/4.27, 4.26, 909, 220/212, 630; 206/511, 509, 508; 232/43.1, 43.2, 435; 229/125.03

[56] References Cited

U.S. PATENT DOCUMENTS

| | | | |
|---|---|---|---|
| 64,810 | 5/1867 | Templeton | 220/212 |
| 1,778,175 | 10/1930 | Thune | 220/212 |
| 2,496,792 | 2/1950 | Hellberg | 220/212 |
| 3,079,037 | 2/1963 | Schechter | 220/212 |
| 3,123,246 | 3/1964 | Spinoza | 220/212 |
| 3,321,130 | 5/1967 | Cleghorn | 232/43.2 |
| 3,369,691 | 2/1968 | Tohchung Wei | 220/4.27 |
| 3,606,074 | 9/1971 | Hayes | 220/630 |
| 3,854,582 | 12/1974 | Martinelli | 206/508 |
| 3,856,178 | 12/1974 | Norgaard | 206/509 |
| 3,954,178 | 5/1976 | Mason | 206/509 |
| 4,203,525 | 5/1980 | Okubo | 220/4.26 |
| 4,311,238 | 1/1982 | Smith | 206/508 |
| 4,444,324 | 4/1984 | Grenell | 220/4.27 |
| 4,700,842 | 10/1987 | Grusin | 206/509 |
| 4,860,910 | 8/1989 | Zipper | 220/909 |

FOREIGN PATENT DOCUMENTS

| | | | |
|---|---|---|---|
| 203018 | 11/1986 | European Pat. Off. | 220/909 |
| 284059 | 9/1988 | European Pat. Off. | 220/909 |

*Primary Examiner*—Stephen Marcus
*Assistant Examiner*—S. Castellano
*Attorney, Agent, or Firm*—Christopher Duffy

[57] ABSTRACT

The container comprises two or more tube-like storage modules that are stacked on top of one another and interconnected by a plate-like lid which is removably interposed in the joint between the modules and has male/female joint-forming attachment grooves on the upper and lower sides thereof, which mate with in-turned out-turned flanges on the lower and upper rims of the modules, respectively, to form a joint in which the modules are releasably interlocked against relative movement in the lateral directions thereof. The modules have open-ended bins therewithin, and additional openings in the sides thereof through which a pair of panels are removably insertable to form false bottoms for the bins, or in the alternative, to open the bottoms of the bins for the unloading operation, when the panels are removed from the bins. Further additional openings in the sides of the modules, above the panel receiving openings, serve as entry ports through which refuse can be loaded in the respective bins of the modules, so that two types of refuse can be loaded in the respective bins, with the bottom forming panel of the relatively upper module segregating one bin from the other. Later, when the container is to be unloaded, the two types can be separately unloaded through the top and bottom openings of the stack of modules, and/or through the respective top and/or bottom openings of the respective modules when they have been separated from the lid by relatively lifting one module away from the other. Commonly, the upper module is also equipped with a lid of similar nature, and when there are more than two modules in the stack, this lid may serve in turn as a coupler for the pair of modules above and below it, just as the first mentioned lid served as such.

12 Claims, 3 Drawing Sheets

48
46
70
72
50
40
16
24
14
4
26
54
12
18
10
62
68
10'
8
2
30
44
6
36
20
10"

COMPARTMENTALIZED REFUSE CONTAINER

RELATED APPLICATION

This Application is a continuation-in-part of my copending application U.S. Ser. No. 349,325 filed May 8, 1989 under the same title.

1. Technical Field

This invention relates to a container for holding refuse and the like, and especially household and office refuse. In particular, the invention relates to a refuse container wherein two or more types of refuse can be segregated from one another in the container, and then separately unloaded from the container when the container is emptied. The invention is especially useful in segregating recyclable and non-recyclable refuse from one another, and if desired, segregating two or more types of recyclable refuse from one another at the same time as the recyclable is segregated from the non-recyclable.

2. Background Art

Compartmentalized refuse containers are known, but they do not enable the user to segregate two or more types of refuse in the container, and then subsequently preserve the segregation as he unloads the refuse from the container. For example, see U.S. Pat. No. 1,266,634 to Briese wherein a divider panel is employed to divide the interior of the container into two compartments, but wherein no provision is made for separately loading and unloading the compartments for the purposes mentioned. In U.S. Pat. No. 992,006, U.S. Pat. No. 4,739,849, U.S. Pat. No. 3,856,173 and U.S. Pat. No. 3,720,346, compartmentalized containers are also shown, but again no provision is made for separately loading and unloading the compartments for the purposes mentioned.

DISCLOSURE OF THE INVENTION

According to the invention, a standing container is provided once again, like that disclosed in the earlier Application, but in this instance, the container comprises a pair of relatively upper and lower tube-like storage modules that are stacked on top of one another and interconnected by coupler means removably interposed in the joint therebetween. The container also comprises a pair of panels which are removably insertable in the pair of modules to form false bottoms for the modules. Each module has an annular wall structure which is arranged upright in the container and defines the sides of the module and a hollow bin therewithin for refuse. Each wall structure also has a relatively upper rim about the top thereof which forms first joint-forming attachment means on opposing sides of the module at the top of the wall structure; and a relatively lower rim about the bottom thereof which forms second joint-forming attachment means on opposing sides of the module at the bottom of the wall structure. In addition, each wall structure has an opening at the top thereof that is formed within the relatively upper rim of the wall structure, an opening at the bottom thereof that is formed within the relatively lower rim of the wall structure, and a pair of additional openings in the body of the wall structure that are formed to open to the outside of the module at levels between the top and bottom openings of the wall structure. One of the additional openings is formed in a horizontal plane adjacent the bottom of the bin, and the other additional opening is formed at a level which is disposed above the one additional opening and relatively adjacent the top opening of the wall structure. The one additional opening is generally rectangular in outline, moreover, to form a horizontally extending slot-like recess in the bottom portion of the wall structure for receiving the respective panel for the module. The panel is removably insertable in the bin of the respective module through the recess, and there are means disposed about the bin at the level of the recess to support the panel crosswise of the bin at that level, so that the panel forms a closed bottom for the bin, but will open the bin to the bottom opening of the wall structure when it is removed from the bin. The coupler means, meanwhile, are releaseably engaged with the relatively lower and upper rims of the relatively upper and lower modules, respectively, and have third and fourth joint-forming attachment means on the opposing relatively upper and lower sides thereof, respectively, which are cooperatively engageable with the second and first joint-forming attachment means on the relatively lower and upper rims of the modules to form a joint in which the modules are releaseably interlocked against relative movement in the lateral directions thereof. The other additional openings in the wall structures of the modules are adapted, meanwhile, to form entry ports for loading refuse in the respective bins of the modules, so that two types of refuse ca-n be loaded in the respective bins, with the bottom forming panel of the relatively upper module segregating one bin from the other, and then when the container is to be unloaded, the two types can separately unloaded through the respective top and bottom openings of the stack of modules, and/or through the respective top and/or bottom openings of the respective modules when the respective modules have been relatively separated from the coupler means by relatively lifting one module away from the other.

In many of the presently preferred embodiments of the invention, the first and fourth joint-forming attachment means, and the second and third joint-forming attachment means, form male/female joints therebetween, respectively. Moreover, the wall structure of each module has a quadrilateral cross section at the sides thereof, and the first and second male/female joint-forming attachment means are disposed on all four sides of the respective quadrilateral rims of the wall structure. The coupler means have a frame-like periphery which is quadrilateral in outline, and the third and fourth male/female joint-forming attachment means are disposed on all four peripheral edge portions of the coupler means, at the relatively upper and lower sides thereof, respectively, and are cooperatively engageable with the second and first male/female joint-forming attachment means on the rims of the relatively upper and lower modules, at all four sides of the respective rims. The respective second and third male/female joint-forming attachment means, and the respective first and fourth male/female joint-forming attachment means, also have cooperatively engageable detent means therein to releaseably interlock the coupler means and the respective modules against relative movement in the vertical directions thereof. However, the respective detent means are disengageable from one another under a predetermined vertical force, to enable the coupler means to be relatively detached from the respective modules, and vice versa, when the modules are to be unloaded.

In certain of the presently preferred embodiments of the invention, the coupler means take the form of a plate-like lid that covers the center of the bin in the relatively lower module and has a quadrilateral flange about the margins thereof which covers the periphery of the bin. The flange has a quadrilateral outline at the inner periphery thereof which is smaller than that of the wall structure of the modules, but a quadrilateral outline at the outer periphery thereof which is greater than that of the wall structure of the modules. It also has a pair of circumferential grooves in the body thereof, one of which is disposed on the relatively upper side of the lid, within the relatively inner peripheral portion of the flange, and the other of which is disposed on the relatively lower side of the lid, within the relatively outer peripheral portion of the flange. Each module, meanwhile, has a relatively out-turned flange on the relatively upper rim thereof, and a relatively in-turned flange on the relatively lower rim thereof. The out-turned flange has a corbel around the inner peripheral edge thereof, and the in-turned flange has a circumferential groove around the inner peripheral edge thereof. The recess opens into the bin at the level of the groove in the in-turned flange, so that the bottom portion of the in-turned flange forms a ledge on which the panel rests after it has been inserted in the recess and slideably engaged in the groove to form a false bottom for the bin of the module.

The recess may take the form of an aperture having a full rectangular outline at the outer peripheral edge thereof, designed to guide the panel into the groove of the in-turned flange. Or the recess may open into the bottom edge of the wall structure, and there may be corbel-like projections at the ends of the edge opening of the recess, to give the recess a general slot-like configuration for the introduction of the panel into the groove of the in-turned flange.

Commonly, the relatively upper module is also equipped with a lid of similar shape and construction as that employed as the coupler means between the pair of modules. Commonly too, each lid has a handle formed thereon, at the upper side thereof. Preferably, the handle is flush with the upper side of the lid. For example, in certain presently preferred embodiments of the invention, each lid has a recess formed in the center portion thereof at the upper side thereof, and the recess is equipped with a handle that is raised at the center of the recess, but flush with the upper side of the lid so that the handle can be readily gripped, but does not interfere with the addition of a panel immediately above the lid in the next higher module of the stack.

Each panel also commonly has a handle on the trailing edge portion thereof.

BRIEF DESCRIPTION OF THE DRAWINGS

These features will be better understood by reference to the accompanying drawings which illustrate two of the presently preferred embodiments of the container.

In the drawings.

BEST MODE FOR CARRYING OUT THE INVENTION

Figures 1, 2:
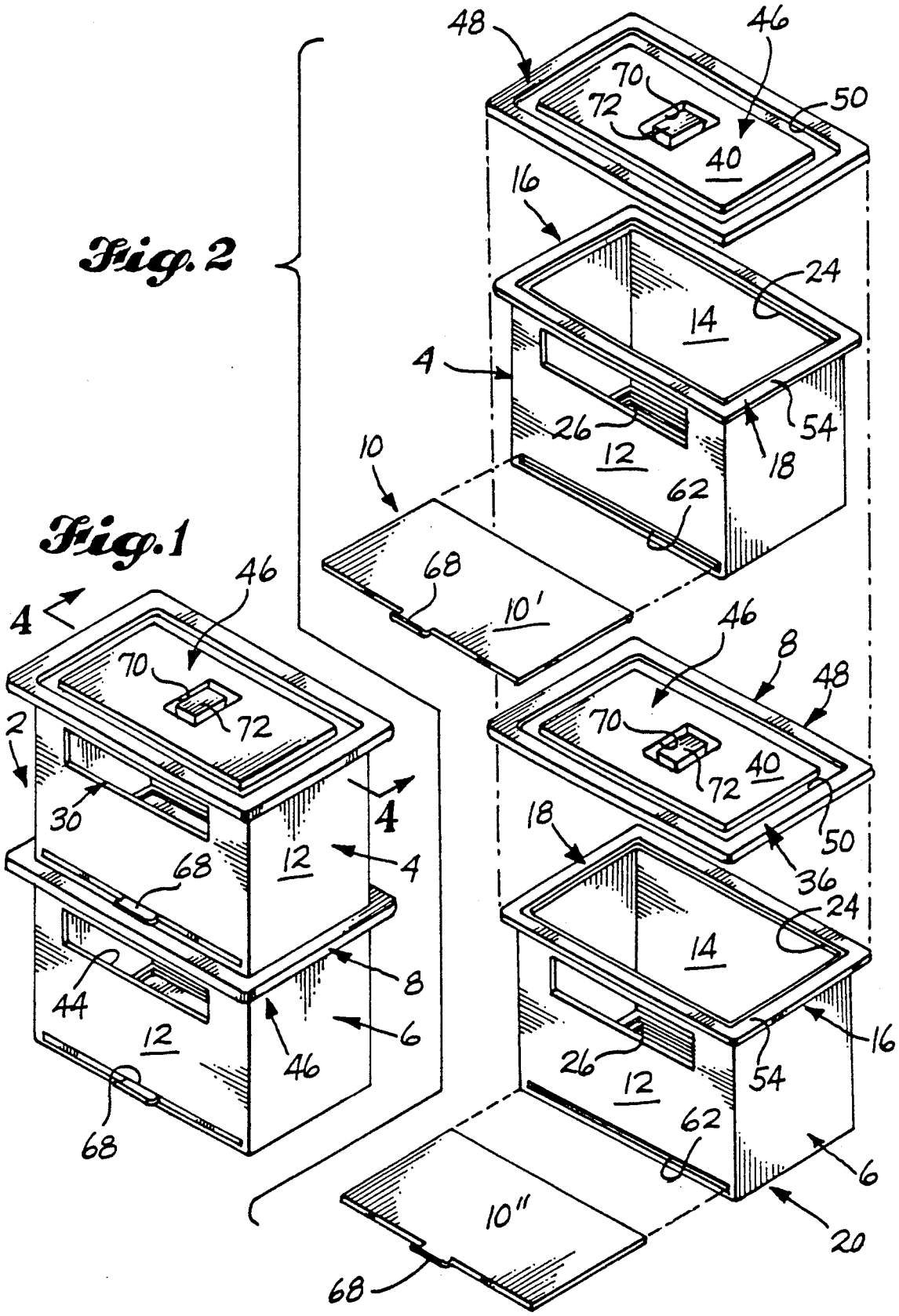
FIG. 1 is a perspective view of one embodiment of the container.
FIG. 2 is an exploded perspective view of the one embodiment.
Figure 4:
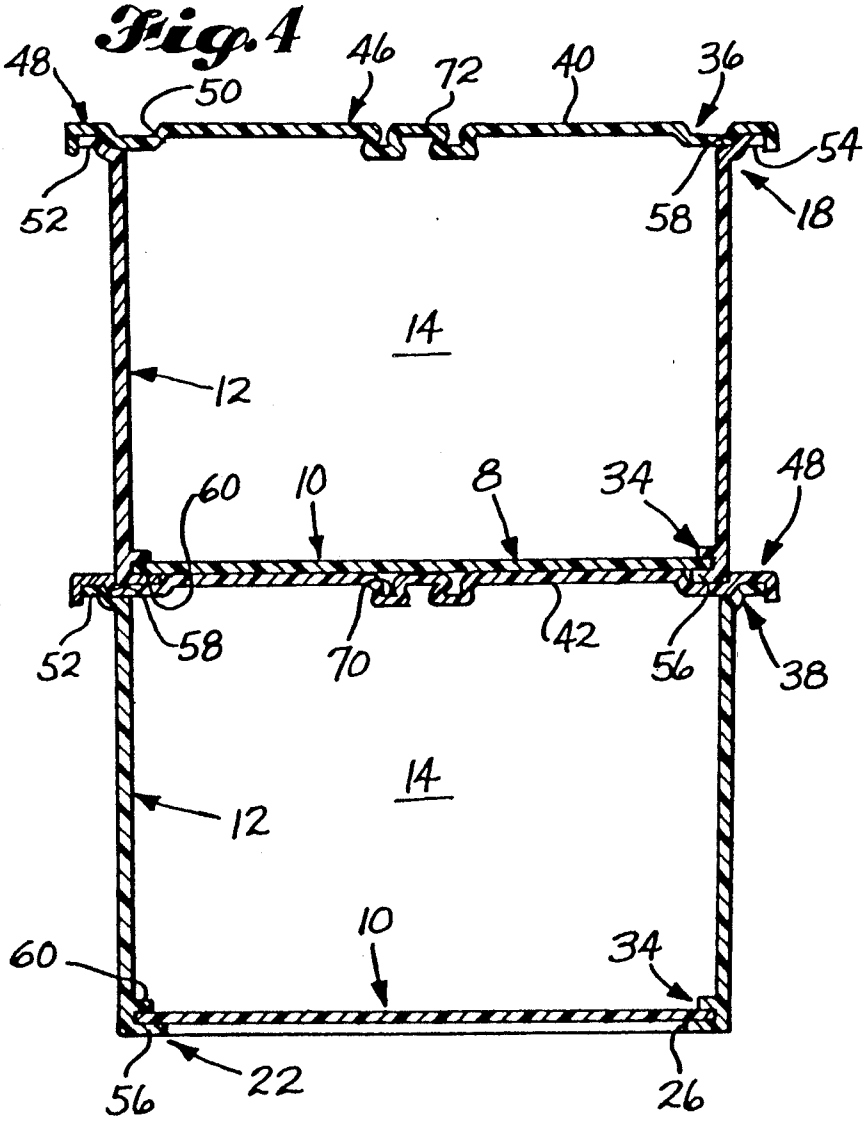
FIG. 4 is a vertical cross sectional view of the one embodiment along the line 4—4 of FIG. 1.
Figure 3:
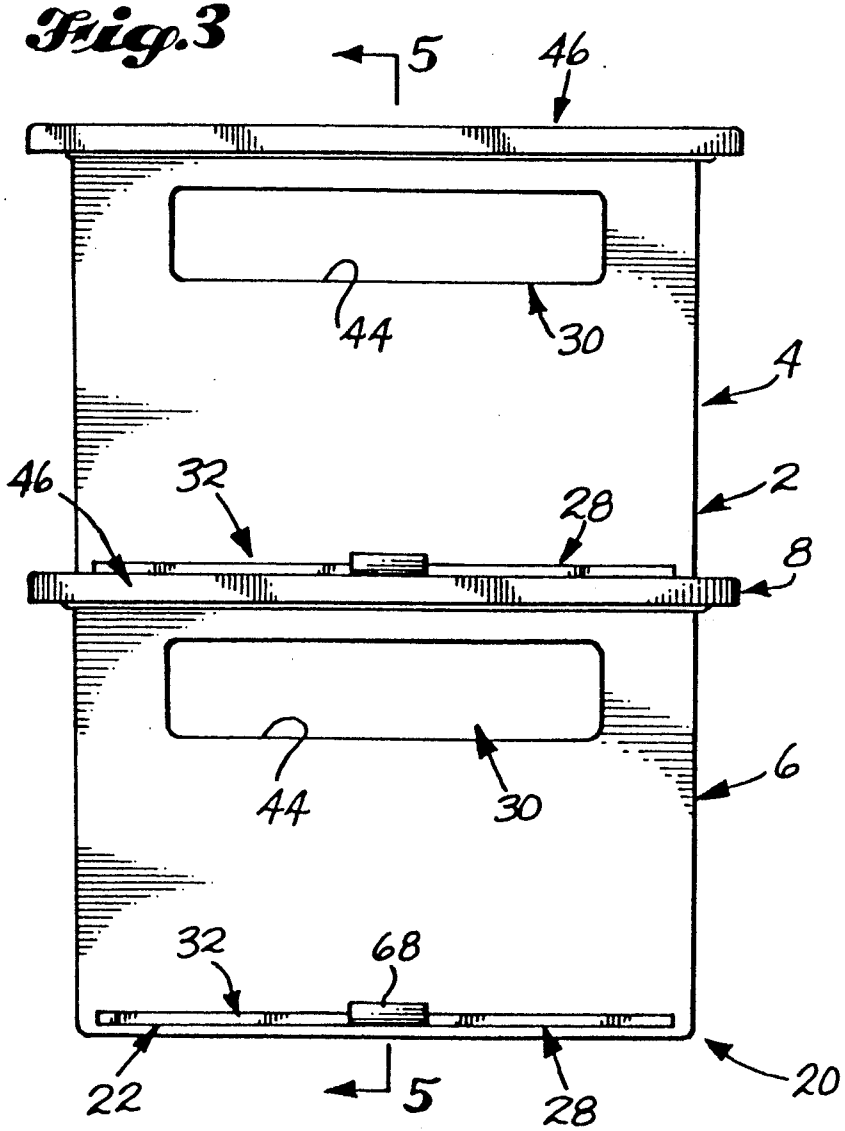
FIG. 3 is a front elevational view of the one embodiment.
Figure 5:
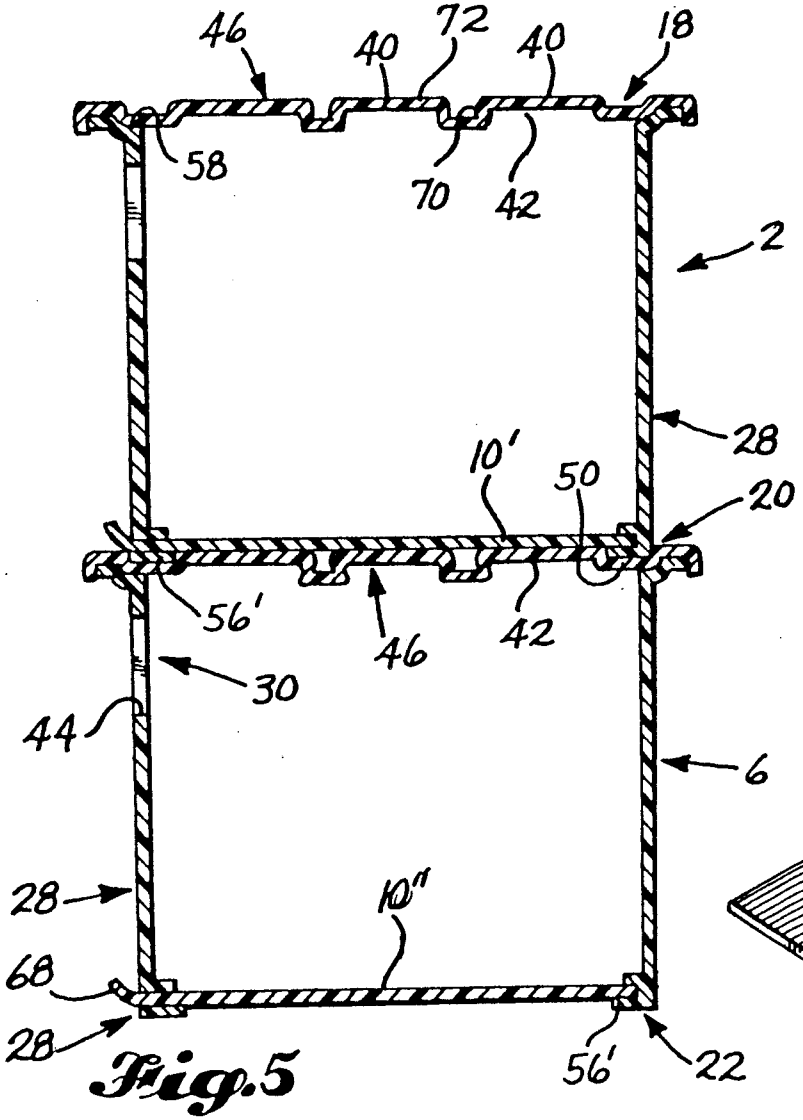
FIG. 5 is a vertical cross sectional view of the one embodiment along the line 5—5 of FIG. 3.

Referring to the drawings, it will be seen that the container 2 comprises a pair of relatively upper and lower tube-like storage modules 4 and 6, respectively, that are fabricated from plastic material, stacked on top of one another, and interconnected by plastic coupler means 8 removably interposed in the joint therebetween. The container 2 also comprises a pair of plastic panels 10 which are removably insertable in the pair of modules to form false bottoms for the modules, as shall be explained. Each module has an annular wall structure 12 which is arranged upright in the container 2 and defines the sides of the module and a hollow bin 14 therewithin for refuse. Each wall structure 12 also has a relatively upper rim 16 about the top thereof which forms first male/female joint-forming attachment means 18 on opposing sides of the module at the top of the wall structure 12; and a relatively lower rim 20 about the bottom thereof which forms second male/female joint-forming attachment means 22 (FIGS. 3–5) on opposing sides of the module at the bottom of the wall structure 12. In addition, each wall structure has an opening 24 at the top thereof that is formed within the relatively upper rim 16 of the wall structure, an opening 26 (FIG. 4) at the bottom thereof that is formed within the relatively lower rim 20 of the wall structure, and a pair of additional openings 28 and 30 in the body of the wall structure that are formed to open to the outside of the module at levels between the top and bottom openings 24 and 26 of the wall structure. One of the additional openings, 28, is formed in a horizontal plane adjacent the bottom of the bin 14, and the other additional opening 30, is formed at a level which is disposed above the one additional opening 28 and relatively adjacent the top opening 24 of the wall structure. The one additional opening 28 is generally rectangular in outline, moreover, to form a horizontally extending slot-like recess 32 in the bottom portion of the wall structure 12 for receiving the respective panel 10 for the module. The panel 10 is removably insertable in the bin 14 of the respective module through the recess 32, and there are means 34 disposed about the bin at the level of the recess 32 to support the panel crosswise of the bin at that level, so that the panel forms a closed bottom for the bin, but will open the bin to the bottom opening 26 of the wall structure when it is removed from the bin. The coupler means 8, meanwhile, are releaseably engaged with the relatively lower and upper rims 20 and 16 of the relatively upper and lower modules, respectively, and have third and fourth male/female joint-forming attachment means 36 and 38, respectively, on the opposing relatively upper and lower sides 40 and 42 thereof, respectively, which are cooperatively engageable with the second and first male/female joint-forming attachment means 22 and 18 on the relatively lower and upper rims of the modules, to form a male/female joint in which the modules are releasably interlocked against relative movement in the lateral directions thereof. The other additional openings 30 in the wall structures of the modules are adapted, meanwhile, to form entry ports 44 for loading refuse in the respective bins 14 of the modules, so that two types of refuse can be loaded in the respective bins, with the bottom forming panel 10' of the relatively upper module segregating one bin from the other, and then when the container is to be unloaded, the two types can be separately unloaded through the respective top and bottom openings 24 and 26 of the stack of modules, and/or through the respective top and/or bottom openings of the respective modules when the respective modules have been relatively separated from the coupler means 8 by relatively lifting one module away from the other.

More specifically, the wall structure 12 of each module has a correspondingly square or rectangular cross section at the sides thereof, and the first and second male/female joint-forming attachment means 18 and 22 are disposed on all four sides of the respective quadrilateral rims 16 and 20 of the wall structure. The coupler means 8 have a frame-like periphery which is quadrilateral in outline; and the third and fourth male/female joint-forming attachment means 36 and 38 are disposed on all four peripheral edge portions of the coupler means, at the relatively upper and lower sides 40 and 42 thereof, respectively, and are cooperatively engageable with the second and first male/female joint-forming attachment means 22 and 18 on the rims of the relatively upper and lower modules, at all four sides of the respective rims. The respective second and third male/female joint-forming attachment means, and the respective first and fourth male/female joint-forming attachment means, also have interference fits or other cooperatively engageable detent means therein to releaseably interlock the coupler means and the respective modules against relative movement in the vertical directions thereof. But as with most interference fits, the respective detent means are disengageable from one another under a predetermined vertical force, to enable the coupler means to be relatively detached from the respective modules, and vice versa, when the modules are to be unloaded.

Figure 6:
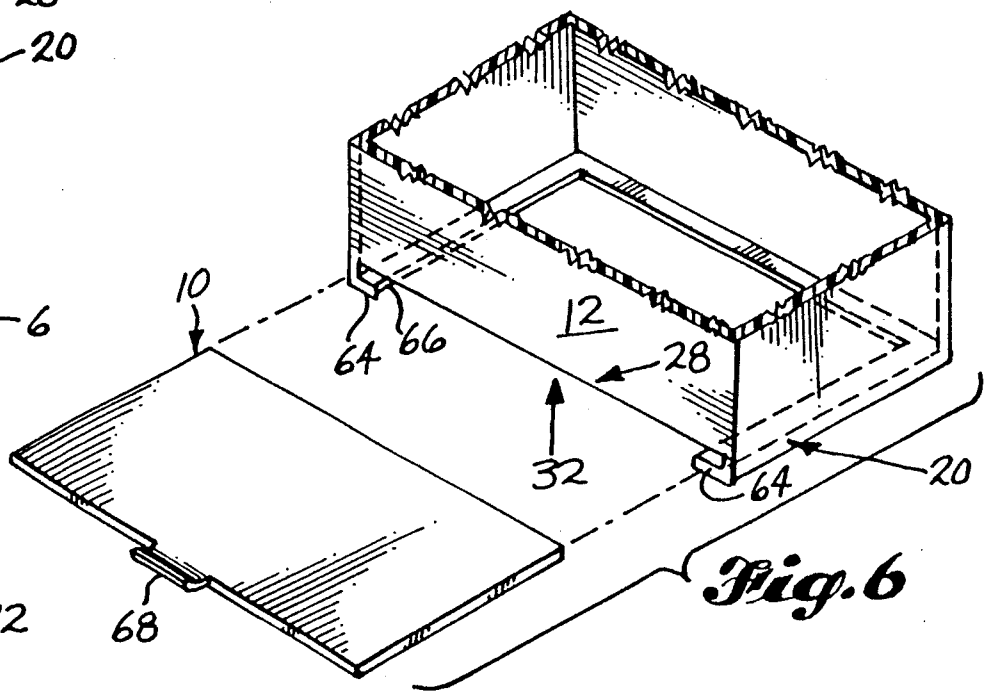
FIG. 6 is a part perspective view of the other embodiment at the bottom of one module, illustrating the different slot-like recess for receiving the panel in the bottom portion of the wall structure of that embodiment.

In fact, the coupler means 8 take the form of a plate-like lid 46 that covers the center of the bin 14 in the relatively lower module 6 and has a quadrilateral flange 48 about the margins thereof which covers the periphery of the bin. The flange, in fact, has a quadrilateral outline at the inner periphery thereof which is smaller than that of the wall structure 12 of the modules, but a quadrilateral outline at the outer periphery thereof which is greater than that of the wall structure of the modules. It also has a pair of circumferential grooves 50 and 52 in the body thereof, one of which, 50, is disposed on the relatively upper side 40 of the lid, within the relatively inner peripheral portion of the flange, and the other of which, 52, is disposed on the relatively lower side 42 of the lid, within the relatively outer peripheral portion of the flange. Each module, meanwhile, has a relatively out-turned flange 54 on the relatively upper rim 16 thereof, and a relatively in-turned flange 56 (FIG. 4) on the relatively lower rim 20 thereof. The out-turned flange 54 has a corbel 58 around the inner peripheral edge thereof, and the in-turned flange 56 has a circumferential groove 60 around the inner peripheral edge thereof, as well as a greater cross sectional outline at the top thereof, above the groove. In the embodiment of FIGS. 1–5, the slot-like recess 32 in the bottom of the wall structure of each module takes the form of an aperture 62 having a full rectangular outline at the outer peripheral edge thereof, designed to guide the panel 10 into the groove 60 of the in-turned flange 56. In the embodiment of FIG. 6, the recess 32 opens into the bottom edge of the wall structure, but there are corbel-like projections 64 at the ends of the edge opening 66 of the recess, to give the recess a general slot-like configuration for the introduction of the panel into the groove 60. In each instance, however, the recess 32 opens into the bin 14 at the level of the groove 60 in the in-turned flange 56 of the module, so that the bottom portion 56' of the in-turned flange 56 forms a ledge on which the panel 10 rests after it has been inserted in the recess 32 and slideably engaged in the groove 60 to form a false bottom for the bin 14 of the module. The panel 10 itself is a flat plate having an upturned lip 68 at the trailing edge thereof, which forms a handle with which to grip the panel for purposes of disengaging it from the groove 60 and removing it through the recess 32 when the bin is to be opened to the bottom opening 26 of the module.

Commonly, the relatively upper module 4 is also equipped with a lid 46 of similar shape and construction as that employed as the coupler means 8 between the pair of modules, but in the case of the additional lid 46, the first and fourth male/female joint-forming attachment means 18 and 38 are employed simply as a means for engaging the lid on the relatively upper rim 16 of the upper module 4, and the lid itself is simply a cover for the bin 14 of the upper module. Of course, given additional modules in the stack, each lid 46 between pairs of modules functions as a coupler means 8 in the same manner as does the lid seen between modules in FIGS. 1–5.

To grasp each lid 46 more readily, a rectangular recess 70 is formed in the center portion of the lid at the upper side thereof, and the recess 70 is disposed crosswise the narrower dimension of the lid, and equipped with a handle 72 that is raised at the center of the recess, but flush with the upper side 40 of the lid. The handle 72 can be readily gripped, therefore, but does not interfere with the addition of a panel 10 immediately above the lid in the next higher module of the stack.

In use, the container 2 is constructed from a plurality of the modules by placing one module on top of another, with a coupler lid 46 therebetween, and pressing the assembly together. Because of the corbel 58, the out turned flange 54 on the relatively upper rim 16 of the relatively lower module 6 is sized to snap engage in the opposing groove 52 in the relatively bottom side 42 of the lid, when the lid is pressed downward on the rim of the module. Moreover, the bottom portion 56' of the relatively in-turned flange 56 on the relatively lower rim 20 of the module 4 thereabove, is sized to snap engage in the groove 50 in the relatively upper side 40 of the lid, when the relatively upper module 4 is pressed downward on the lid. Using the lid as a coupler, therefore, one can interlock the two modules together, both in the lateral directions of the container, and in the vertical directions of the container. The relatively upper panel 10', meanwhile, can be slideably engaged in the groove 60 of the flange 56 immediately above the lid, and the relatively lower panel 10'' can be slideably engaged in the groove 60 of the flange 56 of the lower module, to give both modules a false bottom. Thereafter, when the container has been put to use in holding refuse, and it is desired to unload the respective modules, the lid 46 on the relatively upper module 4 can be removed from it, to enable the upper module to be unloaded through the top opening 24 thereof; or the relatively upper module 4 can be lifted away from the lid 46 between the modules, and the panel 10' can be removed from the bottom of the upper module to enable it to be unloaded through the relatively bottom opening 26 thereof. Additionally, at the same time or at a later time, the lid can be removed from the relatively bottom module 6 to enable it to be unloaded through the top opening 24 thereof, or the panel 10'' can be removed from the bottom module to enable it to be unloaded through the bottom opening 26 thereof.

Once again, as in the earlier Application, each panel 10 may be hinged to the container if desired, so that it remains attached to the container after it has been substantially removed from the recess 32.

When used outdoors, say at curbside, the container and thus the modules as well, may be larger in size. When used indoors, the container and modules may be even so small as to be mountable on a desk or other source of recyclable material such as paper.

When disassembled and free of the lids and panels, the modules themselves may be rendered nestable for storage and transportation, particularly in the form shown in FIG. 6. For example, the modules may be sized in progressively smaller sizes vertically of the stack, and the marginal flanges 48 of the lids 46 may be grooved accordingly to provide a coupler function between each pair of modules.

I claim:

1. In an upright container for holding refuse and the like, a pair of relatively upper and lower tube-like storage modules that are stacked on top of one another to form a joint therebetween, a pair of panels which are removably insertable in the pair of modules to form false bottoms for the modules, each module having an annular wall structure which is arranged upright in the container and defines the sides of the module and a hollow bin therewithin for refuse, each wall structure having a relatively upper rim about the top thereof which forms first joint locking attachment means on opposing sides of the module at the top of the wall structure, and a relatively lower rim about the bottom thereof which forms second joint locking attachment means on opposing sides of the module at the bottom of the wall structure, each wall structure having an opening at the top thereof that is formed within the relatively upper rim of the wall structure, an opening at the bottom thereof that is formed within the relatively lower rim of the wall structure, and a pair of additional openings in the body of the wall structure that are formed to open to the outside of the module at levels between the tip and bottom openings of the wall structure, one of the additional openings in each wall structure being formed in a horizontal plane adjacent the bottom of the corresponding bin, and the other additional opening in each wall structure being formed at a level which is disposed above the one additional opening and relatively adjacent the top opening of the respective wall structure, the one additional opening in each wall structure being generally rectangular in outline to form a horizontally extending slot-like recess in the bottom portion of the wall structure for receiving the respective panel for the module, the panel being removably insertable in the bin of the respective module through the recess, and there being means disposed about the bin at the level of the recess to support the panel crosswise of the bin at that level, so that when inserted the panel can serve as a false bottom for the bin, but will open the bin to the bottom opening of the wall structure when it is removed from the bin, and coupler means which are removably interposed between the relatively upper and lower modules at the joint therebetween and have third and fourth joint locking attachment means on the opposing relatively upper and lower sides thereof, respectively, which are snap engageable with the second and first joint locking attachment means, respectively, on the relatively upper and lower rims of the relatively lower and upper modules, respectively, to form interfering male/female joints between the third and second joint locking attachment means and the fourth and first locking joint attachment means, respectively, that operate to interlock the modules for conjoint movement in the vertical directions thereof, when the relatively upper module is lifted in the vertically upward direction, but which are disengageable under a predetermined vertical force to enable the coupler means to be detached from the respective modules, and vice versa, when the modules are to be unloaded, the other additional openings in the wall structures of the respective modules being adapted to form entry ports for loading refuse in the respective bins of the modules, so that two types of refuse can be loaded in the respective bins, with the panel of the relatively upper module segregating one bin from the other, and then when the container is to be unloaded, the two types can be separately unloaded through the respective top and bottom openings of the stack of modules, and/or through the respective top and/or bottom openings of the respective modules when the coupler means have been disengaged from at least one of the first and second attachment means and the respective modules have been relatively separated from one another by relatively lifting one module away from the other.

2. The upright container according to claim 1 wherein the wall structure of each module has a quadrilateral cross section at the sides thereof, and the first and second male/female joint-locking attachment means are disposed on all four sides of the respective quadrilateral rims of the wall structure, and wherein the coupler means have a frame-like periphery which is quadrilateral in outline and the third and fourth male/female joint-locking attachment means are disposed on all four peripheral edge portions of the coupler means, at the relatively upper and lower sides thereof, respectively, and are cooperatively engageable with the second and first male/female joint-locking attachment means on the rims of the relatively upper and lower modules, at all four sides of the respective rims.

3. The upright container according to claim 1 wherein the coupler means take the form of a plate-like lid that covers the center of the bin in the relatively lower module and has a quadrilateral flange about the margins thereof which covers the periphery of the bin.

4. The upright container according to claim 3 wherein the flange has a quadrilateral outline at the inner periphery thereof which is smaller than that of the wall structure of the modules, but a quadrilateral outline at the outer periphery thereof which is greater than that of the wall structure of the modules, and wherein the flange also has a pair of circumferential grooves in the body thereof, one of which is disposed on the relatively upper side of the lid, within the relatively inner peripheral portion of the flange, and the other of which is disposed on the relatively lower side of the lid, within the relatively outer peripheral portion of the flange, and wherein each module has a relatively out-turned flange on the relatively upper rim thereof, and a relatively in-turned flange on the relatively lower rim thereof, the out-turned flange having a corbel around the inner peripheral edge thereof, the in-turned flange having a circumferential groove around the inner peripheral edge thereof, and the recess opening into the bin at the level of the groove in the in-turned flange, so that the bottom portion of the in-turned flange forms a ledge on which the panel rests after it has been inserted in the recess and slideably engaged in the groove.

5. The upright container according to claim 4 wherein the recess takes the form of an aperture having a full rectangular outline at the outer peripheral edge thereof, designed to guide the panel into the groove of the in-turned flange.

6. The upright container according to claim 4 wherein the recess opens into the bottom edge of the wall structure, and there are corbel-like projections at the ends of the edge opening of the recess, to give the recess a general slot-like configuration for the introduction of the panel into the groove of the in-turned flange.

7. The upright container according to claim 4 wherein the relatively upper module is equipped with a lid of similar shape and construction as that employed as the coupler means between the pair of modules.

8. The upright container according to claim 7 wherein each lid has a handle formed thereon, at the upper side thereof.

9. The upright container according to claim 8 wherein the handle is flush with the upper side of the lid.

10. The upright container according to claim 8 wherein each lid has a recess formed in the center portion thereof at the upper side thereof, and the recess is equipped with a handle that is raised at the center of the recess, but flush with the upper side of the lid so that the handle can be readily gripped, but does not interfere with the addition of a panel immediately above the lid in the next higher module of the stack.

11. The upright container according to claim 1 wherein each panel has a handle on the trailing edge portion thereof.

12. The upright container according to claim 3 wherein the lid has a substantially uniform thickness thereacross between the opposing margins thereof.

* * * * *

UNITED STATES PATENT AND TRADEMARK OFFICE

CERTIFICATE OF CORRECTION

PATENT NO. : 5,062,539

DATED : November 5, 1991

INVENTOR(S) : John W. Chandler

It is certified that error appears in the above-identified patent and that said Letters Patent is hereby corrected as shown below:

Column 7
Claim 1, line 54 thereof, "tip" should be --top--

Signed and Sealed this

Sixth Day of July, 1993

*Attest:*

Michael K. Kirk

MICHAEL K. KIRK

*Attesting Officer*

*Acting Commissioner of Patents and Trademarks*